US005936586A

United States Patent [19]

Maloney

[11] Patent Number: 5,936,586

[45] Date of Patent: Aug. 10, 1999

[54] VHF-UHF WAVEGUIDE NON-METAL AND METAL DETECTOR

[76] Inventor: Daniel P. Maloney, Rt. 1, Box 313G, 1163 120 St., Roberts, Wis. 54023

[21] Appl. No.: 08/841,206

[22] Filed: Apr. 29, 1997

[51] Int. Cl.[6] ..... H01Q 1/16

[52] U.S. Cl. ..... 343/742; 343/741; 343/744; 343/890

[58] Field of Search ..... 343/741, 742, 343/743, 744, 879, 890, 891, 748, 895, 896; H01Q 1/16

[56] References Cited

U.S. PATENT DOCUMENTS 3,550,137 12/1970 Kuecken ..... 343/744
5,138,262 8/1992 Podhrasky ..... 324/327
5,621,418 4/1997 Maloney ..... 343/742
5,696,490 12/1997 Maloney ..... 340/555

*Primary Examiner*—Robert H. Kim
*Assistant Examiner*—Layla Lauchman

[57] ABSTRACT

A VHF-UHF waveguide non-metal and metal detector is disclosed having a waveguide antenna system of aluminum tubing with 4 aperture/slits at critical angles including dielectric centers in conjunction with a waveguide collector system of 2 sets of conical collectors mounted on a main unit containing a waveguide diaphragm and waveguide receiver case including receiver antenna wires with no metal contact.

1 Claim, 5 Drawing Sheets

FIG. 5
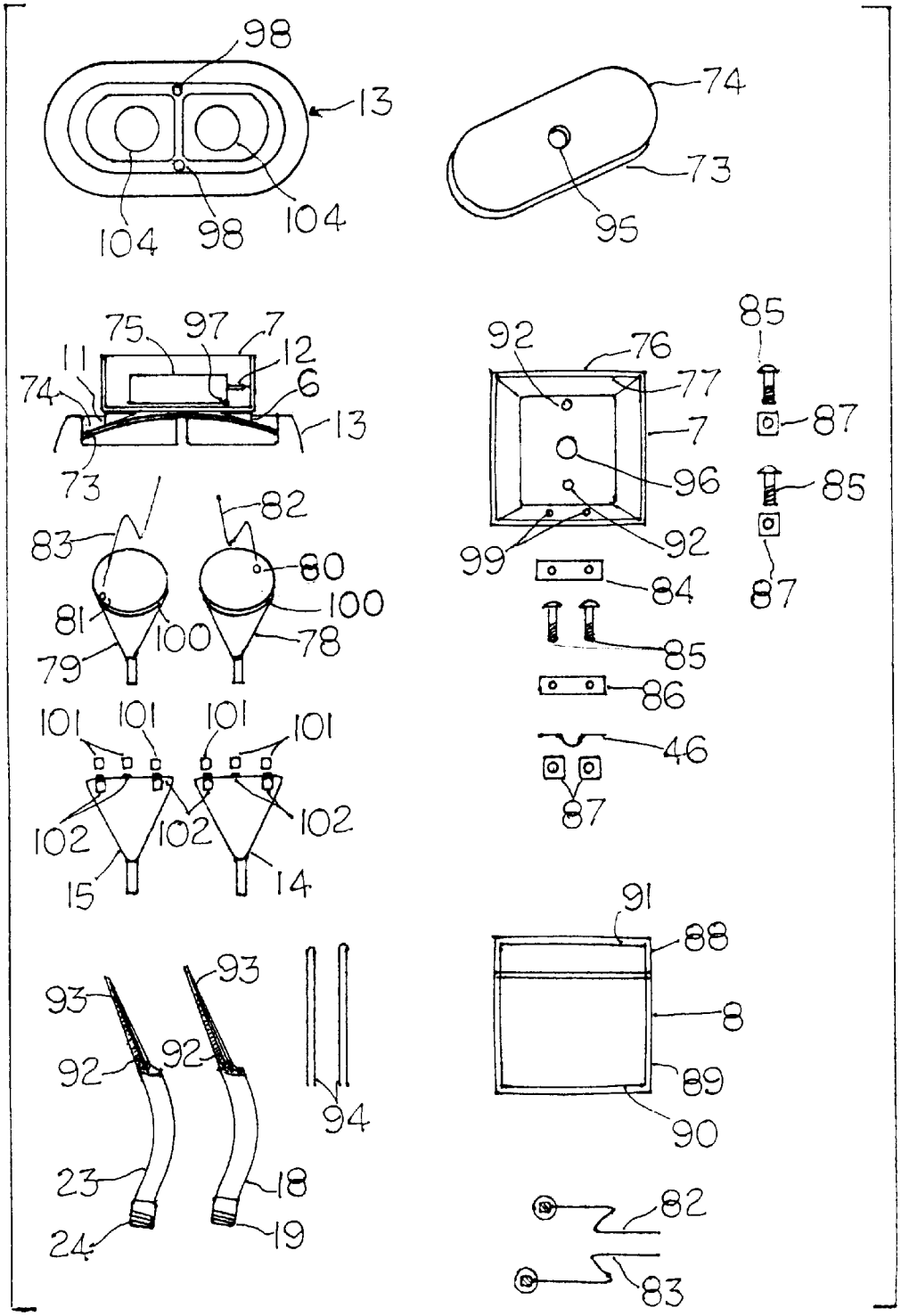
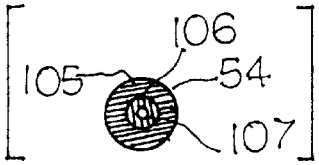
FIG. 6

VHF-UHF WAVEGUIDE NON-METAL AND METAL DETECTOR

BACKGROUND OF THE INVENTION

The field of this invention relates generally to non-metal detectors and metal detectors using UHF (ultra high frequency) and VHF (very high frequency) and VHF-FM propagated radio and television waves several hundred feet deep in the ground (or other conductive environment) or less and responsive to detection of non-metal and metal objects in any environment which allows detection.

In regards to the background of the invention the prior art in most cases uses long cables to attach search instruments to detector, tuning is hard to do and some use very long lengths of electrical cable stretched out across the surface of the ground to transmit and detect objects. Most all of the prior art detectors will not detect plactic, glass, or similar types of objects, but instead are metal detectors.

SUMMARY OF THE INVENTION

Accordingly, an important object of the present invention is to provide an efficient, uncomplicated, lightweight, UHF-VHF, VHF-FM non metal and metal detector with extreme sensitivity to propagated radio/television waves several hundred feet deep in the ground (or other conductive environment) or less and any environment which allows detection.

Another object of the invention is to provide a rigid antenna for a more rugged environment.

Another object of the invention is to provide easier tuning and selection for search pass of the detection system.

In accordance with one aspect of the present invention, it is provided with a waveguide antenna system with 4 aperture/slits at critical angles and a waveguide collector system which also acts as two more detectors.

In accordance with another aspect of the present invention further objects as mentioned above are accomplished by an aluminum tube waveguide antenna with a dielectric center and with aluminum and plastic waveguide collector detectors allowing a larger range and easier selection of tuning.

BRIEF DESCRIPTION OF THE DRAWINGS

FIG. 5 is an enlarged view illustrating the individual components/sections which comprise the waveguide collector system according to the invention.

FIG. 6 is a sectional view taken along line 6—6 of FIG. 3.

DESCRIPTION OF THE PREFERRED EMBODIMENT

Figure 1:
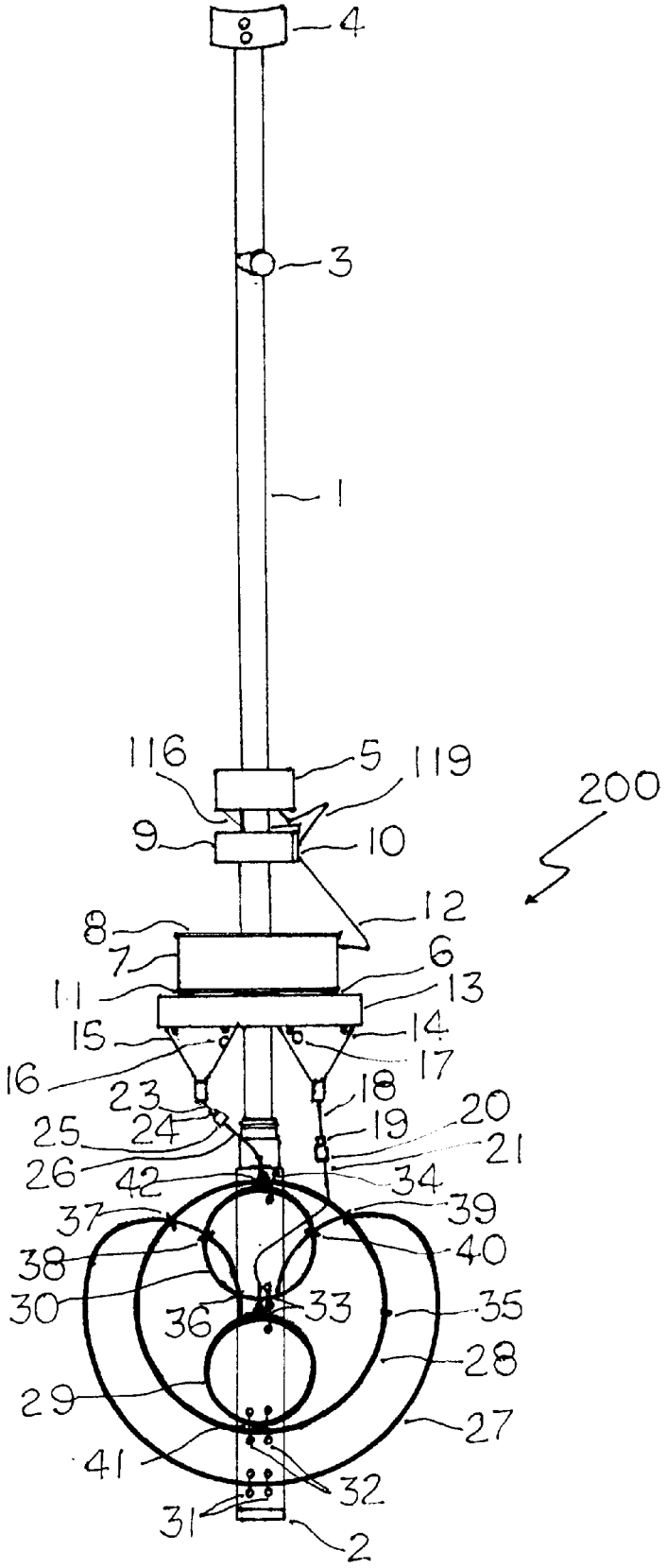
FIG. 1 is a top plan view showing essential features of my invention.

In FIG. 1, there is shown from the drawing a VHF-UHF Waveguide Non-Metal/Metal Detector, System 200, which comprises an ¼ inch aluminum tube waveguide antenna FIG. 1 and a 3 layer FIG. 6, vinyl 105, polypropylene 106, and nylon 107, dielectric in two full lengths inside the tube system FIG. 3, FIG. 4, 54 & 55 and FIG. 6 and consisting of modified loops 29 and 30 FIG. 1, a full curve antenna 27 FIG. 1 connected to each loop 29 and 30, a full circle non-directional antenna 28 FIG. 1 with full curve antenna 27 on top of full circle antenna 28 and loop 30 at crossover points, 14½ in. W×13½ in. L.

Figure 3:
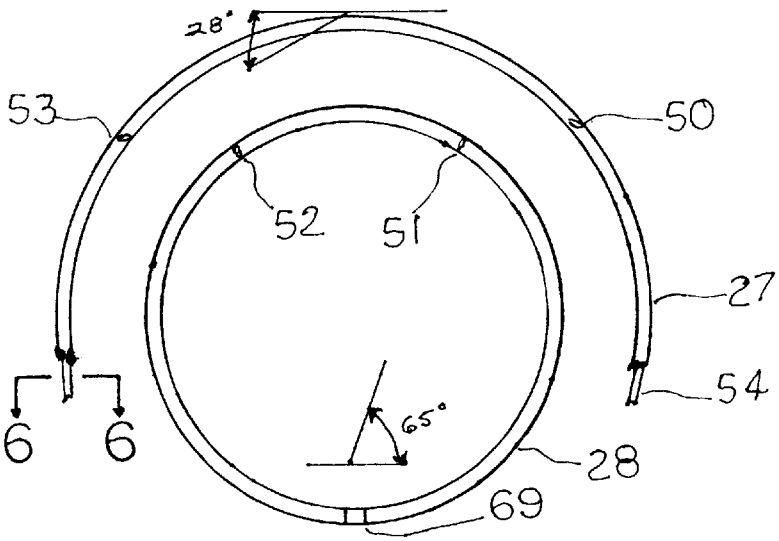
FIG. 3 is a sectional view along line 3—3 of FIG. 2.

The full circle antenna 28 has aperture/slits 51 & 52 FIG. 3 and 51 & 52 are placed at an angle of 65° FIG. 3 from a line two inches, FIG. 3 above the inside of the bottom of the full circle antenna 28. The full curve antenna 27 FIG. 3 also has aperture/slits 50 & 53 FIG. 3. The aperture/slits 50 & 53 are placed at a 28° angle FIG. 3 from a line across the outside of the full curve loop FIG. 3. The aperture/slits are ⅛ inch long by 3/64 inch wide and made with a flat file until a needle point can be pushed through the middle first then carefully push needle through ends until an eye type aperture is made.

Figure 2:
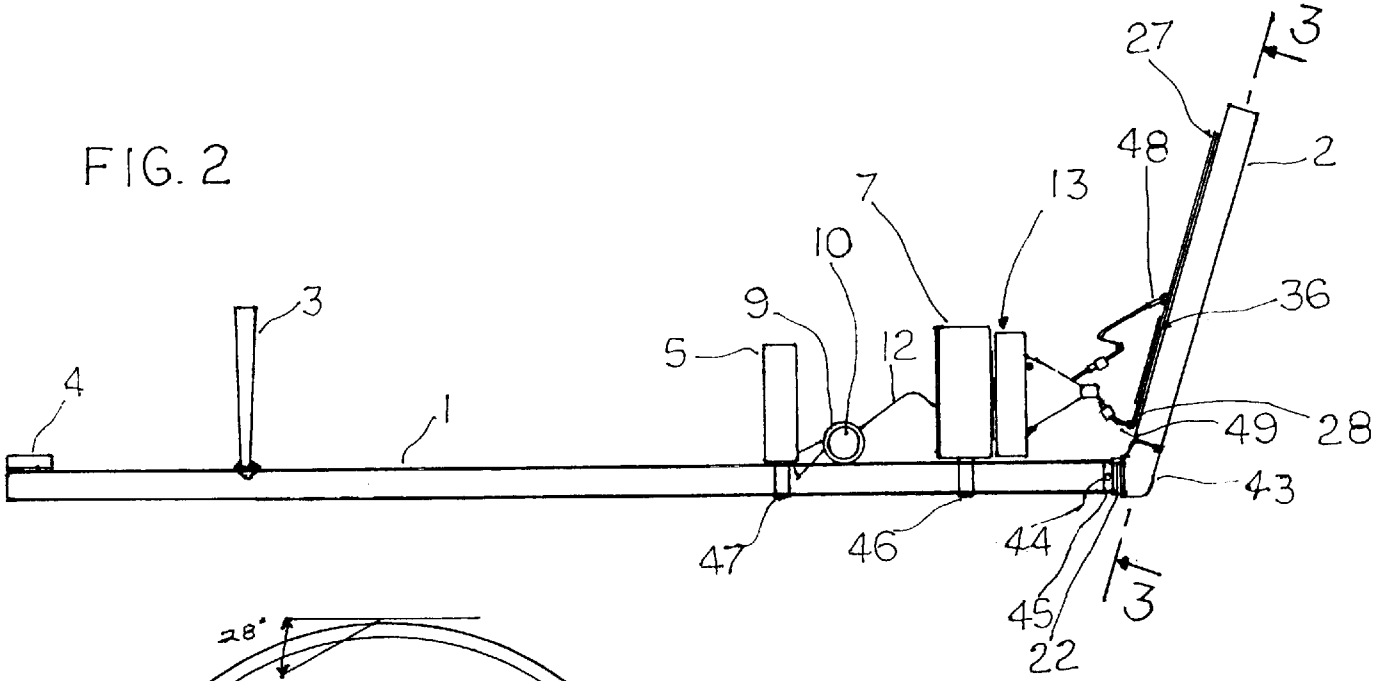
FIG. 2 is a right elevational view showing waveguide system.
Figure 4:
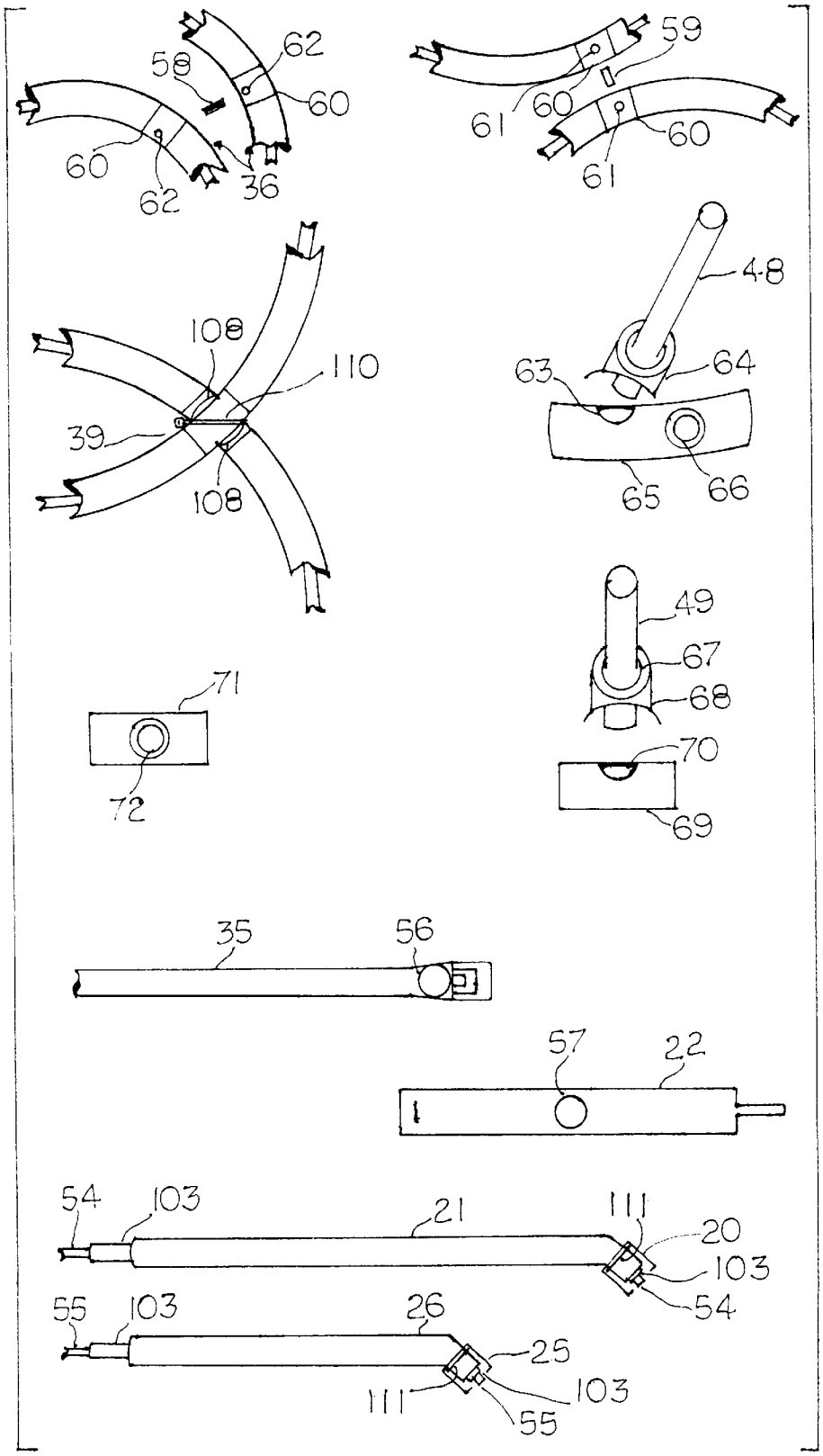
FIG. 4 is an enlarged view illustrating the individual connections which comprise the waveguide antenna system according to the invention.

The full circle antenna 28 FIG. 1 has a 3 layered dielectric 55 FIG. 4 and FIG. 6, running all the way through in one piece and out the aluminum connecting tube 49 FIGS. 2 & 4. The inside of rubber tube 26 FIG. 4, which is the outside of a coax antenna has a rolled up aluminum foil 103 FIG. 4 to shield the dielectric and act as a guide.

The full curve antenna 27 FIG. 1 has a 3 layered dielectric 54 FIG. 4 and FIG. 6 running all the way through the loops 29 and 30 and out aluminum connecting tube 48 FIG. 2 and FIG. 4 and also up through connecting tube 21 FIG. 1 and FIG. 4. The inside of rubber tube 21 FIG. 4 which is also the outside of a coax antenna, has a rolled up aluminum foil 103 FIG. 4 to shield the dielectric and act as a guide. The dielectric used in this invention in 54 and 55 FIG. 4 is clothesline.

The waveguide antenna system has interaction connections at points 39, 40, 41, 37, 38 and 42 FIG. 1. These have 3/32 of an inch hole 60 FIG. 4 and a ⅛ inch long hollow plastic tube 59 FIG. 4 is inserted through electrical tape 60 and hole 61. The joint such as 39 FIG. 1 and FIG. 4 has a narrow aluminum foil strip 108 FIG. 4 wrapped tight and not touching the ¼ inch aluminum tube and has adhesive applied to keep it tight. An 8 inch long by 3/16 inch electrical nylon tie 110 is pulled tight and locked to secure the joints FIG. 4. The joints at 41 and 42 FIG. 1 do not have the nylon tie 110 FIG. 4 directly on them. At 41 and 42 FIG. 1 the nylon ties 32 and 34 FIG. 1 secure the aluminum tubes together as well as to wood frame 2 FIG. 1. At point 36 FIG. 1 a 1/16 of an inch hole is used because of the interaction point. In FIG. 4 a 1/16 of an inch hole 62 is drilled into the two tubes on the outside bottom. A group of 5 polypropylene fibers 58 FIG. 4 is inserted into the 1/16 inch holes 62 and also through the holes in the electrical tape 60. There is aluminum foil wrapped around the joint and adhesive applied to keep it tight and a nylon tie is not used.

The ¼ inch aluminum full circle antenna 28 FIG. 1 has a sleeve 69 FIG. 4 and is inserted into the ends. The sleeve 69 also has a hole 70 FIG. 4 for the ¼ inch aluminum tube 49 to fit into. The tube 49 has a reinforcer sleeve 68 and fixed inside sleeve 67 as well as all the sleeves 69, 65 and 71 FIG. 4 do. The tube and assembly are secured with a semiconductor muffler repair cement made by Locite. The full curve antenna 27 is inserted into sleeve 65 FIG. 4 hole 66 and the ¼ inch aluminum tube 48 is down through the reinforcer sleeve 64 and inserted through hole 63 FIG. 4. The loop 29 is inserted into the ends of sleeve 65 FIG. 4. All of these tubes and sleeves are machine fit and again Locite semiconductor muffler repair cement is used to secure the joints. The other end of the full curve antenna 27 is inserted into sleeve 71 FIG. 4 by sleeve hole 72. The lower loop 30 FIG. 1 is inserted into the ends of sleeve 71. All the tubes and sleeves here are also machine fit and Locite cement is used.

The rubber connecter tubes 21 and 26 FIG. 1 and FIG. 4 has the dielectric 54 and 55 long enough from the tubes 48 and 49 FIG. 2 and FIG. 4 to insert and come all the way up through connecting tubes 21 and 26 FIG. 4. The rubber connecting tubes 21 and 26 have aluminum foil liners 103 FIG. 4 and are slipped over the connecting tubes 48 and 49 about ⅜ of an inch and secured with silicon adhesive.

The aluminum tube waveguide system is secured to wood frame 2 FIG. 1 with the 8 inch by 3/16 inch electrical nylon ties at 31, 32, 33 and 34 FIG. 1.

A torque dipole unit 35 FIG. 1 and FIG. 4 is a 1.4 volt hearing aid battery 56 FIG. 4 bonded to the 8 inch by 3/16 inch nylon electrical tie so the tie may be pulled tight on to the outside of aluminum tube with negative battery side on aluminum tube of the full circle antenna 28 FIG. 4. The dipole applies a torque to the outside of the tube antenna and allows the aperture/slits 50, 51, 52 and 53 FIG. 3 to work smooth and efficient. This point at 35 FIG. 1 was determined from performance and electrical potential at 35 FIG. 1, which is across from the lower loop sleeve 72 FIG. 1.

The waveguide collector system utilizes the dielectric as a conductor and the metal as a guide. The main mounting unit 13 FIG. 1 and FIG. 5 is a moulded unit with two bowl like sides. The receiver case 7 FIG. 1 and FIG. 5 has a plastic shell 77 and a aluminum shell 76 FIG. 5 on the outside. It is provided with mounting holes 92 FIG. 5 to mount to main unit 13 in holes 98 FIG. 5 and bolts and nuts 85 and 87 are used to secure it.

A waveguide diaphragm 73 FIG. 5 which is plastic and waveguide diaphragm 74 which is aluminum, both are glued together by silicon, are 8¼ inches long by 3¾ inches wide. The waveguide diaphragms 73 and 74 are placed between main unit 13 and receiver case 7 FIG. 5. The case 7 has a hole 96 which is ⅞ of an inch wide, and the waveguide diaphragms 73 and 74 FIG. 5 also have a hole 95 which is ⅞ of an inch wide. The holes fit over the midsection of main unit 13 FIG. 5. The waveguide diaphragms 73 and 74 are pushed down on the ends into the main unit 13 by styrofoam wedges 6 and 11 FIG. 1 and FIG. 5.

The main mounting unit has 2 large holes 104 FIG. 5. The plastic funnels 78 and 79 FIG. 5 are 3⅜ of an inch across and each have a hole 80 and 81 FIG. 5. The plastic funnels 78 and 79 with the holes 80 and 81 FIG. 5 would be mounted on main unit 13 in exactly this position, that is right where they are located in the drawing FIG. 5, 78 and 79. The antenna receiver wires have pads of braided copper wire soldered on the end of wires 82 and 83 FIG. 5. These are taped over the holes 80 and 81 FIG. 5 with duct tape 82 and 83 FIG. 5.

The coax antenna cables 23 and 18 FIG. 1 and FIG. 5 with center wire pulled out are sliced to leave an angle and plastic 93 and copper braiding 95% shield 92 FIG. 5, have electrical tape 94 FIG. 5 applied tight over 92 and 93 FIG. 5. These are inserted up into aluminum funnels 14 and 15 FIG. 1 and FIG. 5 and plastic funnels 78 and 79 FIG. 5 are inserted in aluminum funnels 14 and 15 so that ¾ of an inch of the sliced and taped coax cables 23 and 18 FIG. 5 are up and in between the ends of plastic funnels 78 and 79 and the aluminum funnels 14 and 15 FIG. 5. The coax cable 18 and 23 FIG. 5 should be secured with a strong adhesive like goop to both plastic funnels 78 and 79 and aluminum funnels 14 and 15 which will prevent them from pulling out. The waveguide connections must be so that no wires are touching the aluminum collector funnels. The plastic collector funnel must have an aluminum foil 100 FIG. 5 wrapped tightly around the top so it will seal the aluminum collector funnels 14 and 15 FIG. 5 and an adhesive applied to keep it tight.

The conical funnel collectors 14 and 15 are mounted on the main unit 13 over the large holes 104 FIG. 5 and secured with velcro 101 and 102 FIG. 5. The velcro 101 and 102 are secured with a strong adhesive like auto goop, on main unit 13 and aluminum collector funnels 14 and 15 FIG. 5.

The aluminum conical funnels 14 and 15 FIG. 1 and FIG. 5 have torque dipoles taped by a patch of duct tape 16 and 17 FIG. 1, with the negative side of the 1.4 volt hearing aid battery on the aluminum metal.

The receiver wires 82 and 83 FIG. 5 enter the case 7 through main unit 13 at holes 104 and diaphragms 73 and 74 holes 95 and receiver case hole 96 FIG. 5. Wire 82 is inserted and wrapped at first end of receiver antenna 97 FIG. 5 and receiver wire 83 is inserted and wrapped at second end of receiver antenna 97 FIG. 5. Headphone speaker wire 12 FIG. 1 and FIG. 5 are shown in the case FIG. 5 and outside on FIG. 1.

The receiver case 7 FIG. 5 supports the waveguide collector units with bracket 46 FIG. 2 and FIG. 5 around main wood frame 1 FIG. 2. A ⅛ inch leather strap 84 FIG. 5 is placed inside receiver case 7 over holes 99, two bolts 85 FIG. 5 are inserted through 84 and 99 FIG. 5 and a ⅛ inch thich leather strap 86 is put on bolts 85 outside case 7 and mounted on main wood member 1 FIG. 2. The nuts 87 FIG. 5 are turned tight against metal strap 46 FIG. 2 and FIG. 5.

When the waveguide antenna system is connected to the waveguide collector system, connecters 19 and 20 FIG. 4 and FIG. 5 are used. The plastic connecters 19 and 20 are waterproof type used on submersible well pumps. The coax antenna 18 FIG. 5 with braided copper wire and plastic inside are inserted and glued to 19, ½ way back up threads. The female plastic coupler 20 FIG. 4 has the rubber coax, incased aluminum foil 103 and the dielectric 54 FIG. 4 all the way through. The foil 103 is over the top and pushed down to fit against the copper braid of 18 FIG. 5 when turned together. There is a rubber ring 111 FIG. 4 which is put on the coax rubber and glued to keep coupler 20 FIG. 4 from pulling off. The plastic connecters 24 and 25 FIG. 1, FIG. 4 and FIG. 5 are the same type. The coax antenna 23 FIG. 5 with braided copper wire and plastic inside are inserted and glued to 24, ½ way back up threads. The female plastic coupler 25 FIG. 4 has the rubber coax, incased aluminum foil 103 and the dielectric 55 FIG. 4 all the way through. The foil 103 is over the top and pushed down to fit against the copper braid of 23 FIG. 5 when turned together. There is a rubber ring 111 FIG. 4 which is put on the coax rubber and glued to keep coupler 25 FIG. 4 from pulling off.

It is important to note here that both sets of waveguide collectors 14 and 15 FIG. 1 and main unit 13 FIG. 1 along with the diaphragms 73 an 74 FIG. 5 and waveguide receiver case 7 FIG. 1 and FIG. 5 act as detectors for both non-metal and metal. The total waveguide system has the four aperture/slits 50, 51, 52 and 53 FIG. 3 and the 2 collector systems 14 and 15 FIG. 1 working in harmony as detectors, thereby increasing the sensitivity and with better coverage for both non-metal and metal.

The main wood frames 1 and 2 FIG. 1 and FIG. 2 have a ¾ inch 45° elbow 43 FIG. 2 and a 2 inch long ¾ inch connecter 45 FIG. 2 where handle wood frame 1 goes into and a pin 44 FIG. 2 which secures it. A torque dipole 57 attached to aluminum strap 22 FIG. 2 and FIG. 4, with the dipole being a 1.4 volt hearing aid battery with the negative side on the aluminum strap 22 FIG. 4.

Receiver case 7 FIG. 1 and FIG. 5 has a waveguide cover 8 FIG. 1 which is in two pieces, and plastic inside and aluminum outside. The top 91 plastic 88 aluminum FIG. 5. The lower part plastic 90 and aluminum 89 FIG. 5. They are both put together by silicon adhesive between the plastic and aluminum. The bottom 89 and 90 FIG. 5 of cover 8 FIG. 1 and FIG. 5 removes and slides in or out.

Figure 7:
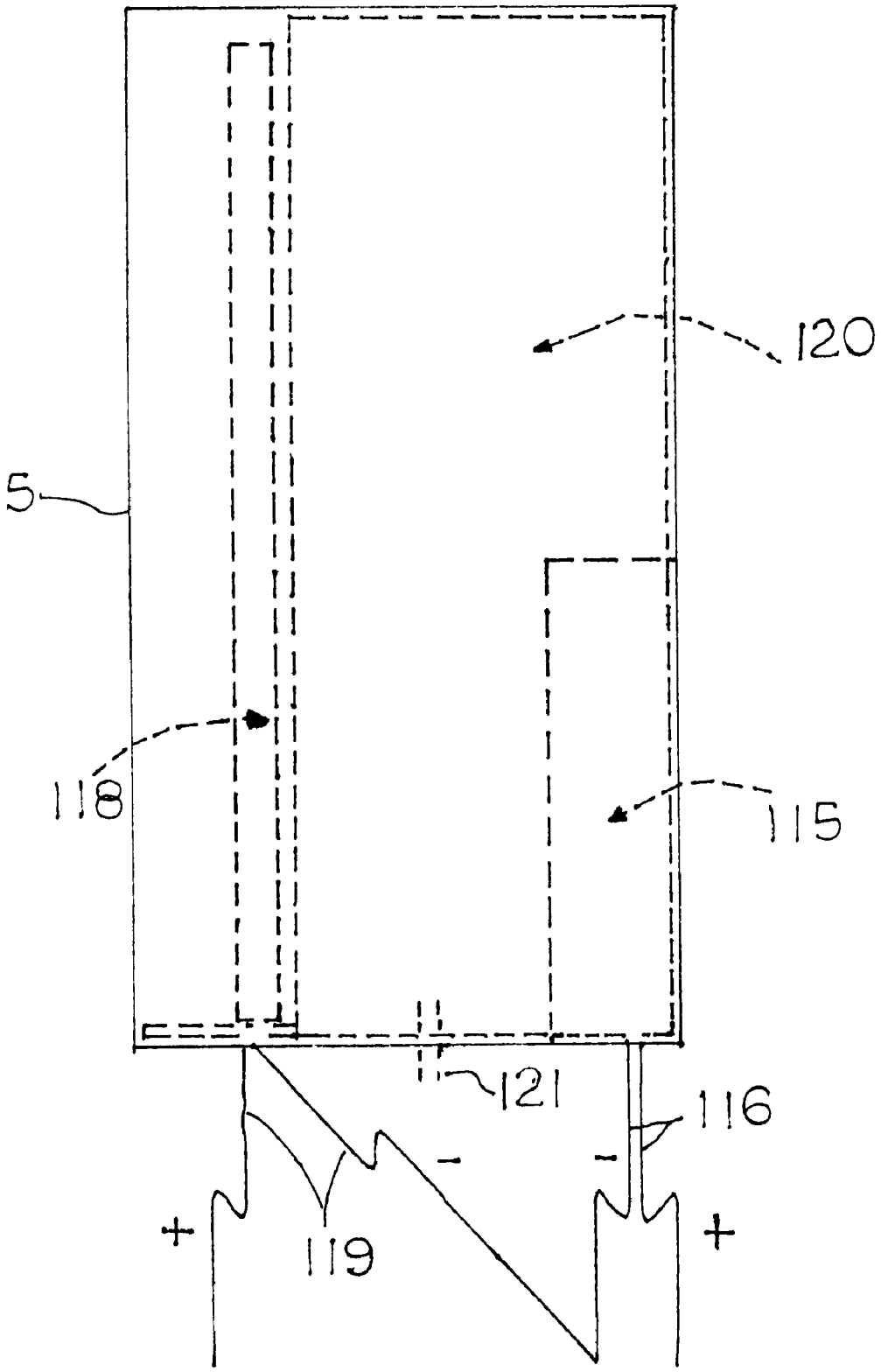
FIG. 7 is an illustration of the case 5 which includes a battery package and digital meter.

Referring now to FIG. 7 there are shown additional details of the meter case 5. Included within the case is a 1½ volt AA battery retainer 115 FIG. 7 with + and − wires 116 out the bottom. Styrofoam 120 FIG. 7 restrains the battery retainer 115 and supports the digital meter 118 which has + and − wires 119 out the bottom. The + battery wire 116 goes to the infrared phototransistor detector in tube 10 FIG. 1. Aluminum tube 10 FIG. 1 is secured by plastic sleeve 9 FIG. 1. The + meter wire 119 also goes to the other connection on the infrared phototransistor detector in tube 10 FIG. 1.

The headphone speaker plug-in wires 12 FIG. 1 from receivers from receivers VHF-UHF goes to the krypton bulb in aluminum case 10 FIG. 1 which transmits data to infrared phototransistor detector. Meter case 5 is mounted on strap 47 FIG. 2 with bolts at 121 FIG. 7. Armrest 4 FIG. 1 and FIG. 2 is used to support the instrument and handgrip 3 FIG. 1 and FIG. 2 is used to lift and guide the instrument.

The receiver wires 82 and 83 FIG. 5 were connected up to an extended double wire antenna to the UHF-VHF on a portable television and the instrument worked very well directly on several channels without any further tuning at all. The detector detected plastic, glass and metal which I buried about 8 inches deep with a meter reading of 1450 to 1500 millivolts. The plastic was from 2 to 4 inches across. The glass was about 1½ inches across. The FM receiver was set at about 0–30 millivolts DC with the tuner and the VHF-FM responded extremely well to the plastic, glass and metal upon detecting and with a digital meter reading of 1450 to 1500 millivolts DC as well. The VHF-FM also responded well upon detection of plastic and copper wire telephone wires buried about 3 feet under the ground and with about the same reading.

The above described preferred embodiment provides a highly efficient detection instrument for non-metal and metal and has 4 aperture/slits and 2 conical collectors all using a waveguide technique with torque dipoles for a smooth efficient detection instrument.

What is claimed is:

1. A VHF-UHF waveguide non-metal and metal detector comprising:

a waveguide antenna system of aluminum tubing and dielectric center with 4 aperture/slits at critical angles, 2 on a full circle section and 2 on the full curve section;

a torque dipole on full circle aluminum tube antenna at critical point across from top of lower loop and sleeve assembly with dipole being a 1.4 volt battery mounted on nylon electrical tie and locked on the outside of full circle antenna with negative side of battery on aluminum tube;

a second dipole taped and sealed with silicon mounted on an aluminum strap with negative of 1.4 volt battery on aluminum strap and strap secured around main frame connecter;

a waveguide collector system of 2 sets of plastic and aluminum conical funnels inserted into each other with each set the plastic inserted into the aluminum conical funnel and the 2 sets of conical funnels acting as and doing detection of non-metals and metal when mounted on main waveguide unit;

said main waveguide collector unit having a flexable diaphragm of plastic inside and aluminum outside bonded together and held down at outer edges into main unit by 2 styrofoam wedges below waveguide receiver case of plastic inside and aluminum outside and having the 2 sets of conical funnels attached to bottom outside of main unit over 2 holes being ½ inch smaller then each inside of the 2 plastic conical funnels;

a waveguide connection system into the 2 sets of conical collector funnels and between small ends of plastic and aluminum conical collector funnels with no metal contact;

a set of receiver antenna wires with braided copper end pads taped over ⅛ inch holes in plastic conical funnels being ¾ of an inch down from the top and at the 8 o'clock and the 2 o'clock positions within plastic conical funnels with no metal contact and wires through larger mounting holes and diaphragm and receiver holes in center of units to be secured to VHF and UHF receiver units as needed;

a set of torque dipoles on the outside of aluminum conical funnels at inside upper positions and being 1.4 volt batteries taped on with negative side of battery on aluminum.

* * * * *